US009089021B2

(12) United States Patent
Suh

(10) Patent No.: US 9,089,021 B2
(45) Date of Patent: Jul. 21, 2015

(54) CONTROLLER OF AN AC-DC CONVERTER FOR LED LIGHTING

(75) Inventor: Young Suk Suh, Daegusi (KR)

(73) Assignee: INDUSTRY-ACADEMIC COOPERATION FOUNDATION, YEUNGNAM UNIVERSITY, Gyeongsan-Si, Gyeongsangbuk-Do (KR)

( * ) Notice: Subject to any disclaimer, the term of this patent is extended or adjusted under 35 U.S.C. 154(b) by 0 days.

(21) Appl. No.: 14/111,553

(22) PCT Filed: Apr. 2, 2012

(86) PCT No.: PCT/KR2012/002457
§ 371 (c)(1),
(2), (4) Date: Oct. 12, 2013

(87) PCT Pub. No.: WO2012/141446
PCT Pub. Date: Oct. 18, 2012

(65) Prior Publication Data

US 2014/0035475 A1 Feb. 6, 2014

(30) Foreign Application Priority Data

Apr. 14, 2011 (KR) ..... 10-2011-0034859

(51) Int. Cl.
*H05B 37/02* (2006.01)
*H05B 33/08* (2006.01)

(52) U.S. Cl.
CPC ..... *H05B 33/0815* (2013.01); *H05B 33/0848* (2013.01)

(58) Field of Classification Search
CPC ..... H05B 33/0803; H05B 33/0809; H05B 33/0815; H05B 33/0845; H05B 41/28; H05B 41/2828; H05B 41/34; H05B 39/09
See application file for complete search history.

(56) References Cited

U.S. PATENT DOCUMENTS

| | | | | |
|---|---|---|---|---|
| 4,672,642 | A * | 6/1987 | Willis et al. | 377/20 |
| 7,804,256 | B2 * | 9/2010 | Melanson | 315/291 |
| 7,847,489 | B2 * | 12/2010 | Lin | 315/291 |
| 7,919,934 | B2 * | 4/2011 | Lin | 315/291 |
| 7,942,553 | B2 * | 5/2011 | Huang | 362/268 |
| 8,044,608 | B2 * | 10/2011 | Kuo et al. | 315/291 |
| 8,169,149 | B2 * | 5/2012 | Klier | 315/224 |
| 8,378,588 | B2 * | 2/2013 | Kuo et al. | 315/291 |
| 8,583,951 | B2 * | 11/2013 | Kuno | 713/321 |

FOREIGN PATENT DOCUMENTS

| | | |
|---|---|---|
| CN | 101193474 | 6/2008 |
| CN | 101621878 | 1/2010 |
| JP | 2006-331799 | 12/2006 |

(Continued)

OTHER PUBLICATIONS

International Search Report for International Application No. PCT/KR2012/002457, dated Nov. 1, 2012.

*Primary Examiner* — Alexander H Taningco
*Assistant Examiner* — Kurtis R Bahr
(74) *Attorney, Agent, or Firm* — Kile Park Reed & Houtterman PLLC

(57) ABSTRACT

The present invention relates to a controller of an AC-DC converter, which controls an LED lighting using electricity of AC 100V to 250V which is used in a building or home, and more particularly, to a controller of an AC-DC converter for LED lighting, which is capable of effectively controlling brightness of an LED lighting.

19 Claims, 4 Drawing Sheets

(56) References Cited

FOREIGN PATENT DOCUMENTS

| | | |
|---|---|---|
| JP | 2008-103199 | 5/2008 |
| JP | 2009-110914 | 5/2009 |
| JP | 2009-245834 | 10/2009 |
| JP | 2010-40400 | 2/2010 |
| JP | 2010-113877 | 5/2010 |
| JP | 2010-282757 | 12/2010 |
| JP | 2011-029154 | 2/2011 |
| KR | 10-0970613 | 7/2010 |
| KR | 10-0993280 | 11/2010 |

* cited by examiner

Flg. 2

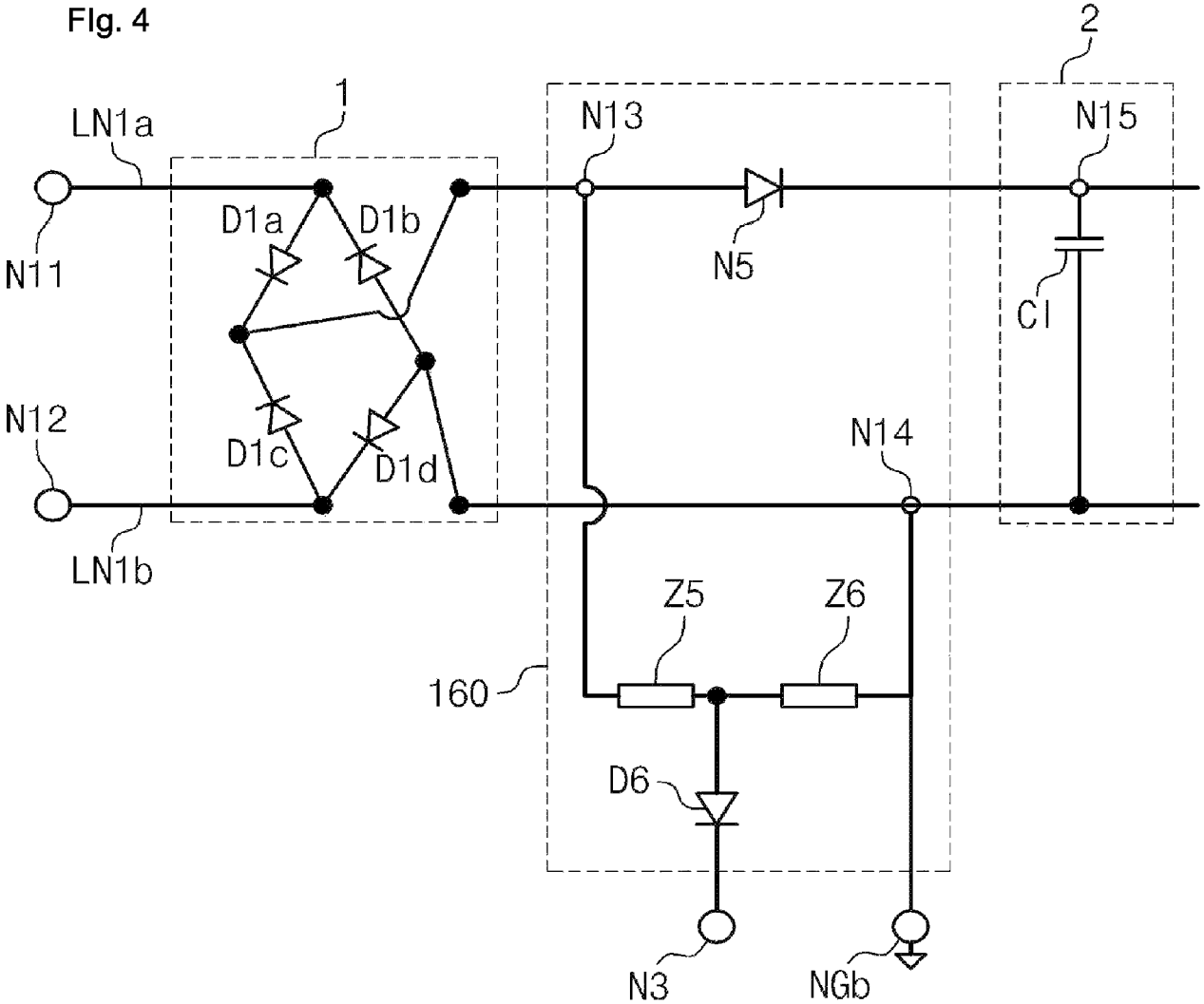
Flg. 4

CONTROLLER OF AN AC-DC CONVERTER FOR LED LIGHTING

TECHNICAL FIELD

The present invention relates to a controller of an AC-DC converter, which controls an LED lighting using electricity of AC 100V to 250V which is used in a building or home, and more particularly, to a controller of an AC-DC converter for LED lighting, which is capable of effectively controlling brightness of an LED lighting.

BACKGROUND ART

An AC-DC converter for LED lighting is used to implement an LED lighting using AC electricity for buildings and interiors, and an AC-DC converter controller serves to control the AC-DC converter. In order to turn on/off an LED lighting which is controlled by the AC-DC converter and the AC-DC converter controller, an AC power switch attached to a wall surface is mainly used.

According to a conventional method for adjusting the brightness of an LED lighting, a console for controlling brightness must be installed on a wall surface, and a separate wired/wireless communication line must be installed between the console and the lighting. As a unit for solving such a problem, a device for adjusting the brightness of the LED lighting may be used. The device serves to adjust the brightness of the LED lighting on the basis of on/off history information which is obtained while an operation of turning on and off the switch on the wall surface is repeated within a given time. Recently, research has been conducted on the device.

In order for the AC-DC converter controller to memorize the on/off information, electrical energy must be supplied to the AC-DC converter controller when AC power is cut off. For such a configuration, a large-capacity battery may be mounted to supply electrical energy when AC power is cut off. However, the large-capacity battery may increase the complexity of the circuit, cause an additional cost, and reduce the lifetime of the AC-DC converter.

When the AC-DC converter controller has a brightness adjustment function based on the on/off information, various brightness adjustment functions may be previously set so that a user easily selects a part of the brightness adjustment functions.

DISCLOSURE

1. Technical Problem

Accordingly, the present invention has been made in an effort to solve the problems occurring in the related art, and an object of the present invention is to provide a controller of an AC-DC converter for LED lighting, which is capable of measuring and storing power on/off information of an AC power line through simple electronic parts when controlling lighting of a building using an AC power of AC 100V to 250V, thereby effectively controlling operations of turning on/off an LED lighting and adjusting the brightness of the LED lighting.

2. Technical Solution

In order to achieve the above object, according to one aspect of the present invention, there is provided a controller of an AC-DC converter for LED lighting, including: an AC power on/off recorder 110 configured to receive an AC power on/off signal s1, measure on/off information on a power-on count, a power-off count, a power-on time, and a power-off time of AC power lines LN1*a* and LN1*b*, and output an AC power on/off recording signal s2; a first sensing circuit 121 configured to generate a first setup signal s6 according to a voltage or current of a first setup terminal N1 connected to the outside; a brightness reference signal generator 120 configured to generate a brightness reference signal s3 in response to the AC power on/off recording signal s2 and the first setup signal s6; an electrical signal processing circuit 130 configured to process a voltage or current measured by the AC-DC converter for LED lighting and output an AC-DC converter state signal s4; and a switching signal generator 140 configured to generate a switching signal s5 so as to implement brightness corresponding to the brightness reference signal s3 using the AC-DC converter state signal s4.

According to another aspect of the present invention, there is provided a controller of an AC-DC converter for LED lighting, including: an AC power on/off recorder 110 configured to receive an AC power on/off signal s1, measure on/off information on a power-on count, a power-off count, a power-on time and a power-off time of AC power lines LN1*a* and NL1*b*, and output an AC power on/off record signal s2; a brightness reference signal generator 120 configured to generate a brightness reference signal s3 in response to the AC power on/off record signal s2; an electrical signal processing circuit 130 configured to process a voltage or current measured by the AC-DC converter for LED lighting and output an AC-DC converter state signal s4; and a switching signal generator 140 configured to generate a switching signal s5 so as to implement brightness corresponding to the brightness reference signal s3 using the AC-DC converter state signal s4. The controller further includes a second power supply terminal NP2 separated from a first power supply terminal NP1 for supplying electricity to the switching signal generator 140 and configured to separately supply electricity to the AC power on/off recorder 110; or a power management circuit 150 configured to operate the AC power on/off recorder 110 and stop the switching signal generator 140 when electricity is not transmitted to the AC power lines, thereby reducing electrical energy consumption.

Advantageous Effects

According to the embodiments of the present invention, the controller of an AC-DC converter for LED lighting may measure and store information when AC power is turned off, and may select and control the brightness adjustment operation and the function of the AC power on/off recorder using simple electronic parts.

BRIEF DESCRIPTION OF THE DRAWINGS

The above objects, and other features and advantages of the present invention will become more apparent after a reading of the following detailed description taken in conjunction with the drawings, in which:

FIG. 4 is a diagram illustrating another example of an AC power sensor included in the controller of an AC-DC converter for LED lighting according to the embodiment of the present invention.

BEST MODE FOR THE INVENTION

Figure 1:
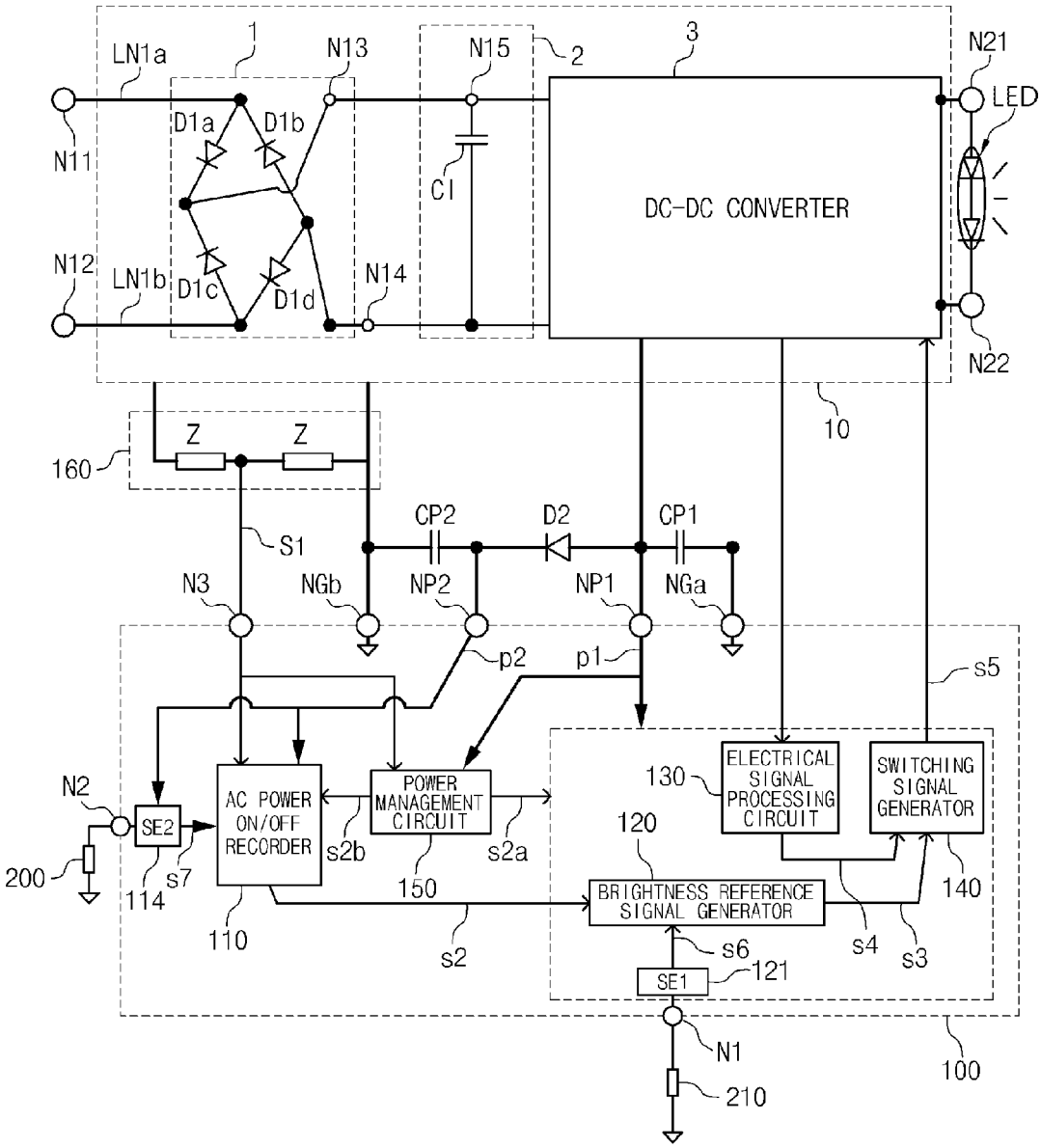
FIG. 1 is a block diagram illustrating connection between a general AC-DC converter for LED lighting and a controller of an AC-DC converter for LED lighting according to an embodiment of the present invention.

Reference will now be made in greater detail to a preferred embodiment of the invention, an example of which is illustrated in the accompanying drawings. Wherever possible, the same reference numerals will be used throughout the drawings and the description to refer to the same or like parts.

FIG. 1 is a block diagram illustrating connection between a general AC-DC converter for LED lighting and a controller of an AC-DC converter for LED lighting according to an embodiment of the present invention.

Referring to FIG. 1, the controller of an AC-DC converter for LED lighting according to the embodiment of the present invention is connected to an AC-DC converter 10 for LED lighting and controls the AC-DC converter 10 for LED lighting.

The AC-DC converter 10 for LED lighting includes a rectifier circuit 1, a low-pass filter 2, and a DC-DC converter 3. The rectifier circuit 1 is configured to rectify a voltage of AC 100V to 250V and convert the rectified voltage into a DC voltage. The low-pass filter 2 is configured to remove high-frequency components of the rectified electricity. The DC-DC converter 3 is configured to supply a suitable current to an LED using the DC voltage having passed through the low-pass filter.

The rectifier circuit 1, the low-pass filter 2, and the DC-DC converter 3 are only examples of components of a general AC-DC converter which is connected to the AC-DC converter controller according to the embodiment of the present invention. The detailed circuit configurations and components thereof are not limited to specific configurations and components. For example, the rectifier circuit 1 may be implemented with a full-wave rectifier circuit including first diodes D1*a*, D1*b*, D1*c* and D1*d* as illustrated in FIG. 1.

Referring to FIG. 1, the controller of an AC-DC converter for LED lighting according to the embodiment of the present invention includes an AC power on/off recorder 110, a first sensing circuit 121, a brightness reference signal generator 120, an electrical signal processing circuit 130, a switching signal generator 140, and a power management circuit 150.

The AC power on/off recorder 110 is configured to receive an AC power on/off signal s1, measure on/off information on a power-on count, a power-off count, a power-on time or a power-off time, and output an AC power on/off record signal s2.

The AC power on/off recorder 110 records on/off information of an AC power line using the AC power on/off signal s1 which is inputted from an AC power sensor when an operation of turning on and off the power switch is repeated a plurality of times, and outputs the on/off information. The on/off information may include one of a power-on count, a power-off count, a power-on time and a power-off time.

The power-on count, the power-off count, the power-on time, and the power-off time may be defined as follows. When a user repeats an operation of turning on and off an LED lighting, how many times the switch is turned on may be set to the power-on count, how long the LED lighting is turned on may be set to the power-on time, how many times the switch is turned off may be set to the power-off count, and how long the LED lighting is turned off may be set to the power-off time.

For example, suppose that the switch of the LED lighting is turned on at t=0, turned off at t=0.9, turned on at t=1.3, turned off at t=1.8, and turned on at t=2.1, the power-on count is 3, the power-off count is 2, the power-on time is 0.9 second (0.9-0) and 0.5 second (1.8-1.3), and the power-off time is 0.4 second (1.3-0.9) and 0.3 second (2.1-1.8).

The brightness reference signal generator 120 may generate a brightness reference signal s3 based on only the AC power on/off record signal s2 of the AC power on/off recorder 110.

As a first example in which the brightness reference signal generator 120 generates the brightness reference signal based on only the AC power on/off record signal s2, the brightness reference signal generator 120 may be previously set in the following manner. The brightness reference signal generator 120 may output a brightness reference signal corresponding to the maximum brightness when the power-on count is 1, may output a brightness reference signal corresponding to 50% of the maximum brightness when the power-on count is 2, and may output a brightness reference signal corresponding to 25% of the maximum brightness when the power-on count is 3. In this case, the brightness of the LED lighting gradually decreases whenever the operation of turning on the LED lighting is performed.

As a second example, the brightness reference signal generator may be previously set to output a brightness reference signal using the power-on time. For example, when a user turns on the power switch, the brightness of the LED lighting continuously increases in proportion to time. When the user wants to maintain the current brightness, the user may turn off the power switch and turn on the power switch again within a predetermined initialization time. Then, the brightness reference signal generator may output a brightness reference signal corresponding to the brightness immediately before the power switch is turned off.

As a third example, the brightness reference signal generator may be previously set in such a manner that the brightness of the LED lighting decreases when the time during which the power switch has been turned off, that is, the power-off time increases.

In the above-described examples, the brightness reference signal is changed according to the power-on count, the power-off count, the power-on time and the power-off time, and various methods for adjusting the brightness may be previously set.

The first sensing circuit 121 is configured to output a first setup signal s6 according to a voltage or current of a first setup terminal N1 connected to the outside, and supply the first setup signal s6 to the brightness reference signal generator 120.

The brightness reference signal generator 120 may generate the brightness reference signal s3 in response to a first setup signal s6 and the AC power on/off record signal s2 which is an output signal of the AC power on/off recorder 110.

When the brightness reference signal generator 120 is implemented to perform various brightness adjustment operations based on one or more pieces of power on/off information among the power-on count, the power-off count, the power-on time and the power-off time, the first setup terminal N1 may be used to select one of the various brightness adjustment operations or change the detailed characteristics of the brightness adjustment operations.

For example, when a voltage of 5V is connected to the first setup terminal N1, a brightness adjustment operation based on the power-on count may be performed, and when a voltage of 0V is connected to the first setup terminal N1, a brightness adjustment operation based on the power-off time may be selected.

For another example, when a resistance of 1 kOhm is connected to the first setup terminal N1, an operation of reducing the brightness by 10% may be performed whenever the LED lighting is turned off and then turned on, and when a resistance of 2 kOhm is connected to the first setup terminal N1, an operation of reducing the brightness by 20% may be performed whenever the LED lighting is turned off and then turned on. At this time, the first sensing circuit 121 senses the voltage of the first setup terminal, which differs according to the resistance connected to the first setup terminal, and generates the first setup signal s6 based on the resistance value. Thus, the first setup terminal N1 is used for a user to change or select a brightness adjustment operation, while the brightness reference signal generator designed to perform various brightness adjustment operations is used as it is.

As a method for changing the voltage or current of the first setup terminal N1, a voltage may be directly applied or a current may be passed. As another method, a circuit may be configured to generate a corresponding voltage when a resistor or capacitor is connected to the first setup terminal N1.

At this time, the first sensing circuit 121 serves to measure a voltage or current of the first setup terminal N1 and generate a corresponding signal. For example, when a resistance connected to the first setup terminal differs, the first sensing circuit 121 senses the voltage or current of the first setup terminal, and generates the first setup signal s6 corresponding to the resistance connected to the first setup terminal N1.

Which type of brightness adjustment operation to set according to the voltage or current of the first setup terminal N1 may be determined when the AC-DC converter controller according to the embodiment of the present invention is fabricated. Even after the AC-DC converter controller is fabricated, a user may change the voltage or current of the first setup terminal N1 of the AC-DC converter controller, and easily select one of various brightness adjustment operations which are predefined or change the detailed characteristics of the brightness adjustment operations.

Thus, when the brightness reference signal generator 120 is previously configured to generate two or more brightness reference signals based on the on/off information in response to the first setup signal s6, the first setup signal s6 may determine one specific operation among the two or more operations.

In order to adjust the brightness again from the beginning, the on/off information within the AC power on/off recorder 110 must be initialized. For example, when the AC power line is powered off, an output signal of the AC power sensor becomes 0. When the power-off state is maintained for a longer time than an initialization time tin, the on/off information may be initialized. Then, when the AC power line is powered on again, the brightness may be changed again from the beginning.

The electric signal processing circuit 130 is configured to process the voltage or current measured by the AC-DC converter for LED lighting and generate an AC-DC converter state signal s4.

For a suitable current or voltage adjustment operation of the DC-DC converter 3, arbitrary kinds of internal currents or a voltage between arbitrary nodes may be measured. The electric signal processing circuit 130 serves to process a voltage or current signal measured by the DC-DC converter. The signal processed by the electric signal processing circuit 130 includes information on the voltage state or current state of the AC-DC converter, and is outputted as the AC-DC converter state signal s4. The electric signal processing circuit 130 may include a buffer having high input impedance and low output impedance, in order to accurately acquire a voltage signal or current signal. The measured AC-DC converter state signal s4 is transmitted to the switching signal generator 140.

The switching signal generator 140 is configured to generate a switching signal s5 to be applied to a control terminal of a power transistor (not illustrated) installed in the AC-DC converter, in order to implement brightness corresponding to the brightness reference signal s3 using the AC-DC converter state signal s4.

The switching-type DC-DC converter includes a switching element to switch a current flowing in one or more conductors. The switching signal generator 140 switches the switching transistor within the DC-DC converter 3 so as to implement the brightness corresponding to the brightness reference signal s3.

In order to switch the switching transistor, a switching transistor driving circuit (not illustrated) is needed. When a reference potential differs between the switching transistor driving circuit and the switching signal generator 140, a coupling circuit (not illustrated) may be used.

When the brightness reference signal s3 is given, a temporal switching method for obtaining brightness corresponding to the brightness reference signal departs from the scope of the present invention, and may be implemented according to an operating method of the existing switching-type DC-DC converter.

As an example for generating a switching signal corresponding to the brightness reference signal, a switching signal for outputting a predetermined frequency of pulse at a variable duty ratio may be used. When the switching transistor within the DC-DC converter performs a switching operation according to the switching signal s5, the current or voltage of the DC-DC converter differs. The difference is measured through the electric signal processing circuit 130 to control the current or voltage of the DC-DC converter.

The controller of an AC-DC converter for LED lighting according to the embodiment of the present invention may further include a second power supply terminal NP2 or a power management circuit 150.

The second power supply terminal NP2 is separated from the first power supply terminal NP1 which supplies electricity to the switching signal generator 140, and separately supplies electricity to the AC power on/off recorder 110.

The power management circuit 150 serves to operate the AC power on/off recorder 110 and stop the switching signal generator 140 when electricity is not supplied to the AC power line, thereby reducing electrical energy consumption.

The controller of an AC-DC converter for LED lighting according to the embodiment of the present invention may measure and record a state in which power supplied to the AC power line is turned on/off. At this time, the AC-DC converter controller may maintain the record on the on/off information within the initialization time tin, even when the AC power is instantly cut off. When the AC power is turned off, the AC-DC converter receives electricity from an energy storage element which stores electrical energy, and all electric charges are consumed within a short time.

When the AC power is turned off, the LED consumes the largest amount of power. In order to cut off power supplied to the LED as soon as possible when the AC power is turned off, the switching signal s5 generated from the switching signal generator 140 may be stopped. The power management circuit 150 senses the AC power-off state using the AC power on/off signal s1, transfers a control signal through a path s2*a* so as to stop the switching signal generator 140. Furthermore, the power management circuit 150 continuously supplies electricity to the AC power on/off recorder 110, and maintains the record on the on/off information during the initialization time tin or more.

Thus, the power management circuit 150 receives the AC power on/off signal s1 so as to determine the power on/off state of the AC power line. When electricity is not supplied to the AC power line, that is, during the power-off state, the power management circuit 150 operates the AC power on/off recorder 110 and stops the switching signal generator 140, thereby reducing electric energy consumption.

As another method for supplying electricity to the AC power on/off recorder 110 during the initialization time tin or more when the AC power is turned off, the power supply terminal for supplying electricity to the AC power on/off recorder 110 may be separated from the circuit including the switching signal generator 140 having large power consumption.

For example, as illustrated in FIG. 1, the electricity is supplied to the switching signal generator 140, the electric signal processing circuit 130, the brightness reference signal generator 120, and the first sensing circuit 121 through the first power supply terminal NP1 and a path p1, and electricity is supplied to the AC power on/off recorder 110 through the second power supply terminal NP2 and a path p2.

A ground terminal NGb of the second power supply terminal NP2 may be commonly connected to a ground terminal NGa of the first power supply terminal NP1.

Figure 2:
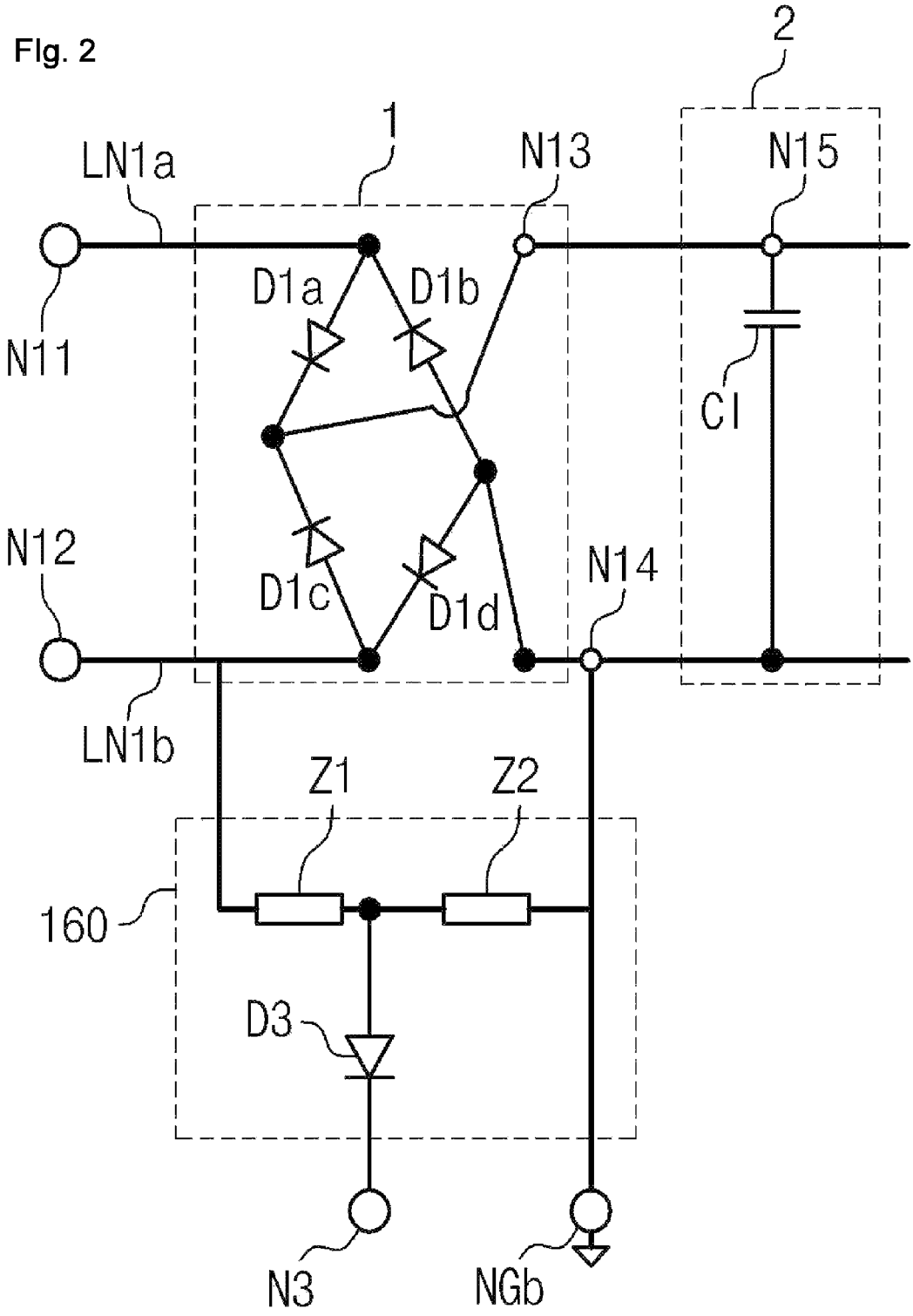
FIG. 2 is a diagram illustrating an example of an AC power sensor included in the controller of an AC-DC converter for LED lighting according to the embodiment of the present invention.
Figure 3:
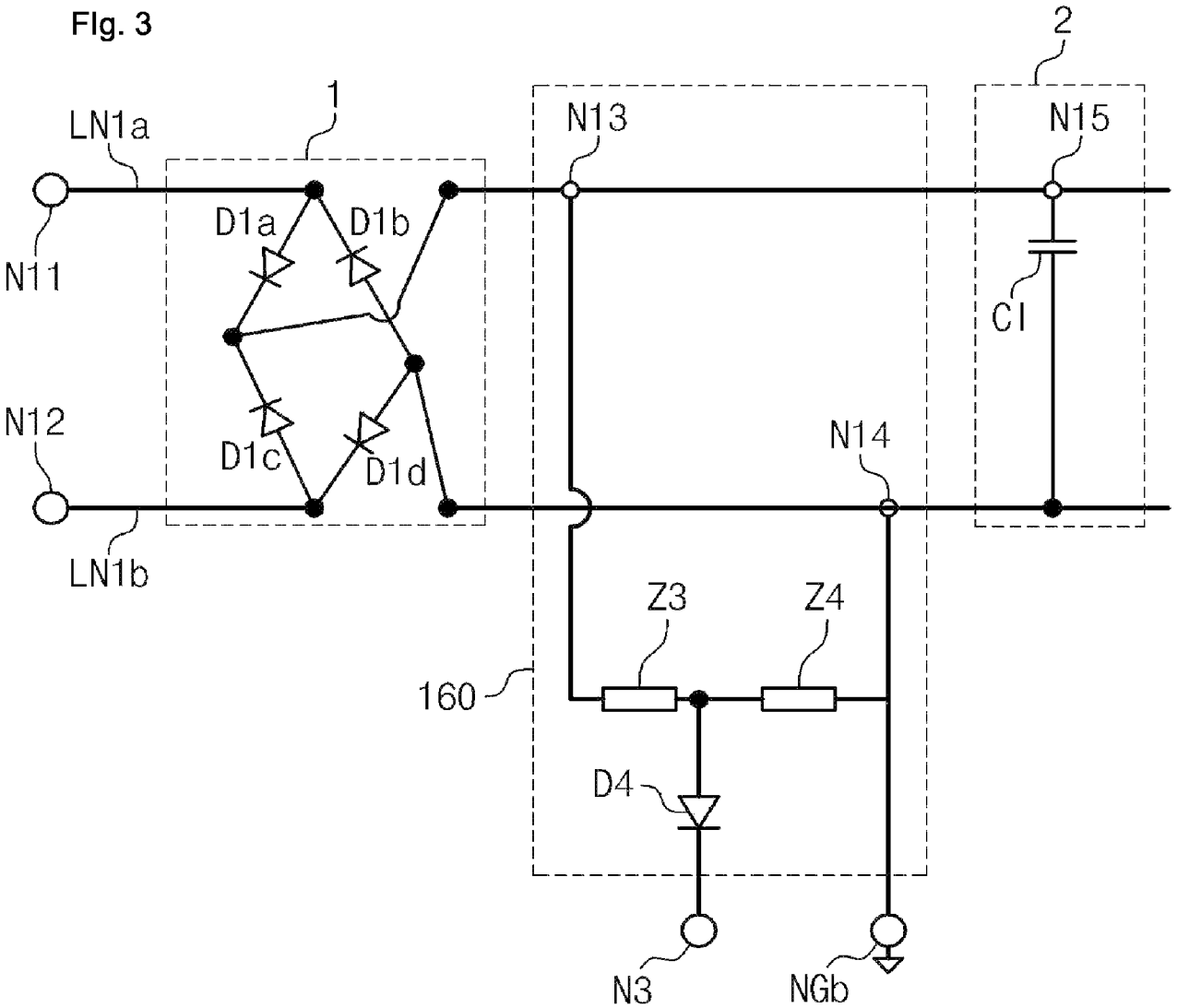
FIG. 3 is a diagram illustrating another example of an AC power sensor included in the controller of an AC-DC converter for LED lighting according to the embodiment of the present invention.

FIGS. 2 to 4 are diagrams illustrating an AC power sensor included in the controller of an AC-DC converter for LED lighting according to the embodiment of the present invention.

As illustrated in FIGS. 1 to 4, the controller of an AC-DC converter for LED lighting according to the embodiment of the present invention may further include an AC power sensor 160 configured to measure power on/off states of the two AC power lines and output the AC power on/off signal s1.

The AC power sensor 160 serves to determine whether electricity used for LED lighting is supplied to the AC power lines or cut off. When voltages are directly measured at both ends of the two AC power lines LN1*a* and LN1*b*, it is possible to determine whether or not electricity is supplied to the AC power lines.

When the AC power sensor is connected to both ends of the AC power lines LN1*a* and LN1*b* so as to determine the on/off states of the AC power lines, it is difficult to couple the AC power sensor to the controller because the voltages differ from the reference potentials NGa and NGb of the AC-DC converter controller. Thus, an additional element such as a photo coupler is needed.

In FIG. 1, the reference potential NG1 and the reference potential NGb are equal to each other. When the reference potentials are equal to each other, the measured output signal of the AC power sensor may be connected to the AC-DC converter controller as it is.

The AC power sensor 160 illustrated in FIG. 2 has input terminals connected to one terminal N11 or N12 of one of the two AC power lines and an output-side low voltage terminal N14 of the rectifier circuit which rectifies electricity supplied to the two AC power lines.

The AC power sensor 160 illustrated in FIG. 3 has input terminals connected to a high voltage terminal N13 and an output-side low voltage terminal N14 of a rectifier circuit which rectifies electricity supplied to the two AC power lines.

The AC power sensor 160 illustrated in FIG. 4 has input terminals connected to an output-side high voltage terminal N13 and an output-side low voltage terminal N14 of the rectifier circuit which rectifies electricity supplied to the two AC power lines. Furthermore, when a low-pass filter is used, a fifth diode D5 is installed between the output-side high voltage terminal N13 of the rectifier circuit and the low-pass filter 2 for reducing a ripple voltage.

When the voltage of the AC power line is turned off, the fifth diode D5 prevents charge stored in the low-pass filter 2 from escaping and flowing into the output-side high voltage terminal N13 of the rectifier circuit 1. Thus, when the AC power is turned off, the AC power sensor 160 may quickly sense the turn-off state.

The potential of the AC power sensor 160 illustrated in FIGS. 2 to 4 may be equalized to the reference potentials NGa and NGb of other circuits of the AC-DC converter controller. Thus, the AC power sensor 160 may be easily connected to other circuits.

The AC power sensor 160 illustrated in FIGS. 2 to 4 may be implemented with a voltage attenuation circuit which attenuates a voltage applied to an input terminal thereof and outputs the attenuated voltage as an output voltage.

The signal processing circuits within the AC-DC converter controller are driven at a low voltage of about 5V. In order to sense an on/off state of a high voltage ranging from AC 100V to 250V, a voltage attenuator is used to reduce the high voltage into a low voltage which may be easily used for signal processing. When a high AV voltage is applied to an input terminal of the voltage attenuator, a low voltage of about 5V is outputted from an output terminal of the voltage attenuator.

When the AC power sensor 160 is implemented with a voltage attenuator, two electronic elements Z1 and Z2, Z3 and Z4, or Z5 and Z6 may be connected in series as illustrated in FIGS. 2 to 4, both ends of the electronic elements may be set to input terminals, and both ends of an electronic element Z2, Z4 or Z5 of each AC power sensor may be set to output terminals.

In a specific embodiment, the electronic elements Z1 to Z6 forming the voltage attenuator may be replaced with resistors. Alternatively, among the electronic elements Z1 to Z6, the electronic elements Z1, Z3 and Z5 may be implemented with resistors, and the electronic elements Z3, Z4 and Z6 may be implemented with Zener diodes.

The AC power sensor 160 illustrated in FIGS. 2 to 4 may further include a third diode, a fourth diode, and a six diode to block a backward current flowing from the output terminal to the input terminal of the AC power sensor.

The AC-DC converter controller according to the embodiment of the present invention needs to measure a power-off time even in a state where the electricity of the AC power line is cut off.

For example, when the power-off time is measured in a state where the electricity of the AC power line is cut off, the AC power on/off recorder may be implemented as illustrated in FIGS. 2, 3 and 4. The third diode D3 of FIG. 2, the fourth diode D4 of FIG. 3, and the sixth diode D6 of the AC power sensor 160 of FIG. 4 may block a backward current flowing from the output terminal to the input terminal of the AC power sensor, thereby preventing charge of the AC power on/off recorder from unnecessarily escaping. Thus, the AC power on/off recorder may smoothly measure the power-off time.

The controller of an AC-DC converter for LED lighting according to the embodiment of the present invention may further include a second sensing circuit 114 configured to generate a second setup signal s7 according to a voltage or current of the second setup terminal N2 connected to the outside, and may initialize the on/off information recorded in the AC power on/off recorder 110 according to the second setup signal s7.

At this time, the initialization time tin may be determined according to the voltage or current of the second setup terminal N2. When the AC power-off state lasts for the initialization time tin or more, the on/off information recorded in the AC power on/off recorder 110 may be initialized to reset the brightness adjustment operation from the beginning.

For example, when a resistance of 1 kOhm is connected to the second setup terminal N2, the initialization time tin may be set to one second, and when a resistance of 2 kOhm is connected to the second setup terminal N2, the initialization time tin may be set to two seconds. At this time, the second sensing circuit 114 senses the voltage of the second setup terminal N2, which differs according to the resistance connected to the second setup terminal N2, and generates a second setup signal s7 based on the resistance.

As a method for protecting the second power supply terminal NP2 of the AC-DC converter controller from the influence of the first power supply power terminal NP1, the AC-DC converter controller for LED lighting according to the embodiment of the present invention may further include the second diode D2 connected between the first power supply terminal NP1 and the second power supply terminal NP2 and configured to prevent a current from flowing from the second power supply terminal to the first power supply terminal, thereby protecting the second power supply terminal from the first power supply terminal.

In order to maintain the measurement operation and record for the AC power on/off when the AC power is turned off, a separate second power supply terminal NP2 for the AC power on/off recorder 110 may be provided, and a capacitor CP2 may be attached to the power supply terminal. When the AC power is turned off, the second diode D2 prevents charge from escaping from the capacitor CP2 connected to the second power supply terminal, even through the electrical energy of the capacitor CP1 attached to the first power supply terminal NP1 is completely consumed. Thus, the second power supply terminal is separated and protected from the first power supply terminal.

For a smooth operation, the capacitor CP2 connected to the second power supply terminal may supply electrical energy to the AC power on/off recorder 110 for the initialization time tin or more. Desirably, the blocks 10 and 100 divided by a dotted line of FIG. 1 may be fabricated in the form of a module or chip. However, this is not limited to the scope of the present invention.

According to the above-described embodiment of the present invention, when AC power is cut off, the AC power on/off information may be measured and stored through the simple circuit configuration. Furthermore, the AC-DC converter controller which is controlled according to the power on/off information of the AC power line may control the brightness adjustment operation and the function of the AC power on/off recorder using simple electronic parts such as capacitors or resistors.

Although a preferred embodiment of the present invention has been described for illustrative purposes, those skilled in the art will appreciate that various modifications, additions and substitutions are possible, without departing from the scope and the spirit of the invention as disclosed in the accompanying claims.

The invention claimed is:

1. A controller of an AC-DC converter for LED lighting, comprising:

an AC power on/off recorder configured to receive an AC power on/off signal and measure on/off information of a power-on count, a power-off count, a power-on time, and a power-off time of AC power lines to output an AC power on/off recording signal;

a first sensing circuit configured to generate a first setup signal according to a voltage or current of a first setup terminal;

a brightness reference signal generator configured to receive the AC power on/off recording signal and the first setup signal to generate a brightness reference signal, wherein the brightness reference signal generator, based on the first setup signal, determines which of the power on/off information of the power-on count, power-off count, power-on time, and power-off time is to be considered when generating the brightness reference signal;

an electrical signal processing circuit configured to process a voltage or current measured by the AC-DC converter for LED lighting and output an AC-DC converter state signal; and a switching signal generator configured to generate a switching signal so as to implement brightness corresponding to the brightness reference signal using the AC-DC converter state signal.

2. The controller of claim 1, further comprising a first power supply terminal separated from a second power supply terminal, the first power supply terminal for supplying power to the switching signal generator and the second power supply terminal configured to separately supply power to the AC power on/off recorder; or a power management circuit configured to operate the AC power on/off recorder and stop the switching signal generator when power is not transmitted to the AC power lines, thereby reducing electrical energy consumption.

3. A controller of an AC-DC converter for LED lighting, comprising:

an AC power on/off recorder configured to receive an AC power on/off signal, measure on/off information on a power-on count, a power-off count, a power-on time and a power-off time of AC power lines, and output an AC power on/off record signal;

a brightness reference signal generator configured to generate a brightness reference signal in response to the AC power on/off record signal;

an electrical signal processing circuit configured to process a voltage or current measured by the AC-DC converter for LED lighting and output an AC-DC converter state signal; and a switching signal generator configured to generate a switching signal so as to implement brightness corresponding to the brightness reference signal using the AC-DC converter state signal, wherein the controller further comprises a first power supply terminal separated from a second power supply terminal by a diode configured to prevent a current from flowing from the second power supply terminal to the first power supply terminal, the first power supply terminal for supplying power to the switching signal generator and the second power supply terminal configured to separately supply power to the AC power on/off recorder.

4. The controller of claim 1, wherein the AC power lines comprises two lines, the controller further comprises an AC power sensor configured to measure power on/off states of the two AC power lines and output the AC power on/off signal, and the AC power sensor has input terminals connected to one terminal of one of the two AC power lines and an output-side low voltage terminal of a rectifier circuit which rectifies electricity transmitted to the two AC power lines.

5. The controller of claim 4, wherein the AC power sensor is implemented with a voltage attenuation circuit which attenuates a voltage applied to an input terminal and outputs the attenuated voltage as an output voltage.

6. The controller of claim 4, wherein the AC power sensor further comprises a third diode configured to block a backward current flowing from an output terminal to an input terminal.

7. The controller of claim 1, wherein the AC power line comprises two lines, the controller further comprises an AC power sensor configured to measure power on/off states of the two AC power lines and output the AC power on/off signal, and the AC power sensor has input terminals connected to an output-side high voltage terminal and an output-side low voltage terminal of a rectifier circuit which rectifies electricity transmitted to the two AC power lines.

8. The controller of claim 7, wherein the AC power sensor is implemented with a voltage attenuation circuit which attenuates a voltage applied to an input terminal and outputs the attenuated voltage as an output voltage.

9. The controller of claim 7, wherein the AC power sensor further comprises a fourth diode configured to block a backward current flowing from an output terminal to an input terminal.

10. The controller of claim 1, wherein the AC power line comprises two lines, the controller further comprises an AC power sensor configured to measure power on/off states of the two AC power lines and output the AC power on/off signal, and the AC power sensor has input terminals connected to an output-side high voltage terminal and an output-side low voltage terminal of a rectifier circuit which rectifies electricity transmitted to the two AC power lines, and comprises a fifth diode installed between the output-side high voltage terminal of the rectifier circuit and a low-pass filter for reducing a ripple voltage.

11. The controller of claim 10, wherein the AC power sensor is implemented with a voltage attenuation circuit which attenuates a voltage applied to an input terminal and outputs the attenuated voltage as an output voltage.

12. The controller of claim 10, wherein the AC power sensor further comprises a sixth diode configured to block a backward current flowing from an output terminal to an input terminal thereof.

13. The controller of claim 1, further comprising a second sensing circuit configured to generate a second setup signal according to a voltage or current of a second setup terminal connected to the outside, wherein the AC-DC converter controller initializes on/off information recorded in the AC power on/off recorder according to the second setup signal.

14. The controller of claim 1, wherein the first setup terminal is connected to a capacitor or resistor.

15. The controller of claim 2, further comprising a second diode connected between the first power supply terminal and the second power supply terminal and configured to prevent a current from flowing from the second power supply terminal to the first power supply terminal.

16. The controller of claim 1, further comprising an AC power sensor configured to measure power on/off states of the AC power lines and output the AC power on/off signal.

17. The controller of claim 16, wherein the AC power sensor is implemented with a voltage attenuation circuit which attenuates a voltage applied to an input terminal and outputs the attenuated voltage as an output voltage.

18. A controller of an AC-DC converter for LED lighting, comprising:

an AC power on/off recorder configured to receive an AC power on/off signal, measure on/off information on a power-on count, a power-off count, a power-on time, and a power-off time of AC power lines, and output an AC power on/off record signal;

a first sensing circuit configured to generate a first setup signal according to a voltage or current of a first setup terminal;

a brightness reference signal generator configured to receive the AC power on/off recording signal and the first setup signal to generate a brightness reference signal;

an electrical signal processing circuit configured to process a voltage or current measured by the AC-DC converter for LED lighting and output an AC-DC converter state signal;

a switching signal generator configured to generate a switching signal so as to implement brightness corresponding to the brightness reference signal using the AC-DC converter state signal; and an AC power sensor configured to measure a power on/off state of the AC power lines and output the AC power on/off signal, wherein the AC power sensor further comprises a diode configured to block a backward current flowing from an output terminal to an input terminal of the AC power sensor and the brightness reference signal generator, based on the first setup signal, determines which of the power on/off state and the power on/off information of the power-on count, power-off count, power-on time, and power-off time is to be considered when generating the brightness reference signal.

19. The controller of claim 1, wherein the first setup signal is generated according to a first voltage, a second voltage, a first current, and a second current.

* * * * *